US007175302B2

(12) United States Patent
Kazar et al.

(10) Patent No.: US 7,175,302 B2
(45) Date of Patent: Feb. 13, 2007

(54) YEAR-ROUND DECORATIVE LIGHTS WITH MULTIPLE STRINGS OF SERIES-COUPLED BIPOLAR BICOLOR LEDS FOR SELECTABLE HOLIDAY COLOR SCHEMES

(75) Inventors: Dennis Michael Kazar, Austin, TX (US); John Jeffery Oskorep, Chicago, IL (US)

(73) Assignee: Year-Round Creations, LLC, Chicago, IL (US)

( * ) Notice: Subject to any disclaimer, the term of this patent is extended or adjusted under 35 U.S.C. 154(b) by 168 days.

(21) Appl. No.: 11/033,643

(22) Filed: Jan. 11, 2005

(65) Prior Publication Data

US 2005/0122718 A1 Jun. 9, 2005

Related U.S. Application Data

(63) Continuation-in-part of application No. 10/678,934, filed on Oct. 3, 2003, now Pat. No. 6,933,680, which is a continuation-in-part of application No. 10/144,149, filed on May 10, 2002, now Pat. No. 6,690,120.

(51) Int. Cl.
*F21S 4/00* (2006.01)
*H05B 37/00* (2006.01)

(52) U.S. Cl. ..... 362/231; 362/236; 362/251; 362/252; 307/12; 315/193; 315/185 S; 345/83

(58) Field of Classification Search ..... 362/231, 362/236, 251, 252; 315/193, 185 S, 185 R; 345/82, 83; 307/11, 12, 36
See application file for complete search history.

(56) References Cited

U.S. PATENT DOCUMENTS 3,623,066 A 11/1971 Norris (Continued)

FOREIGN PATENT DOCUMENTS

WO WO 99/10867 3/1999

(Continued)

OTHER PUBLICATIONS

Guerrero, Lucio; "End the Xmas light fight: Just leave them up"; Red Streak; Tuesday, Dec. 2, 2003; p. 6, vol. 22, No. 22, Chicago Sun-Times Inc.; Chicago, IL, USA.

(Continued)

*Primary Examiner*—Sandra O'Shea
*Assistant Examiner*—Ismael Negron
(74) *Attorney, Agent, or Firm*—John J. Oskorep, Esq.

(57) ABSTRACT

A decorative lighting apparatus includes a decorative light strand having first, second, and third wires, each with a plurality of lamps coupled in series therealong, and a return wire coupled to ends of the first, the second, and the third wires. Each lamp of the plurality of lamps has a first light-emitting diode (LED) device coupled in parallel and in reverse orientation with a second LED device. The first, the second, and the third wires are positioned together such that each lamp of the first, the second, and the third pluralities are positioned adjacent to each other but sufficiently separated such that little or no color mixing occurs between the lamps. The apparatus also includes a controller adapted to control the plurality of lamps to provide different user-selectable color schemes in various simultaneously-illuminated combinations of color.

21 Claims, 9 Drawing Sheets

U.S. PATENT DOCUMENTS

| | | | |
|---|---|---|---|
| 3,789,211 | A | 1/1974 | Kramer |
| 3,946,244 | A | 3/1976 | Davis, Jr. |
| 4,153,860 | A | 5/1979 | Vonick |
| 4,215,277 | A | 7/1980 | Weiner et al. |
| 4,682,079 | A | 7/1987 | Sanders et al. |
| 4,780,621 | A | 10/1988 | Bartleucci et al. |
| 4,890,000 | A | 12/1989 | Chou |
| 5,008,595 | A | 4/1991 | Kazar |
| 5,245,519 | A | 9/1993 | Openiano |
| 5,300,864 | A | 4/1994 | Allen, Jr. |
| 5,359,506 | A | 10/1994 | Koleno |
| 5,451,842 | A | 9/1995 | Chien |
| 5,629,587 | A | 5/1997 | Gray et al. |
| 5,747,940 | A | 5/1998 | Openiano |
| 5,749,646 | A | 5/1998 | Brittell |
| 5,911,501 | A | 6/1999 | Katz |
| 5,944,408 | A | 8/1999 | Tong et al. |
| 5,980,062 | A | 11/1999 | Bell |
| 6,015,218 | A | 1/2000 | Snell |
| 6,033,089 | A | 3/2000 | Tesauro |
| 6,050,701 | A | 4/2000 | Stone |
| 6,064,975 | A | 5/2000 | Moon |
| 6,150,774 | A | 11/2000 | Mueller et al. |
| 6,285,140 | B1 | 9/2001 | Ruxton |
| 6,299,338 | B1 | 10/2001 | Levinson et al. |
| 6,309,086 | B1 | 10/2001 | Tomlinson |
| 6,364,137 | B1 | 4/2002 | Glauth |
| 6,384,545 | B1 | 5/2002 | Lau |
| 6,424,096 | B1 | 7/2002 | Lowe et al. |
| 6,577,080 | B2 | 6/2003 | Lys et al. |
| 6,608,453 | B2 | 8/2003 | Morgan et al. |
| 6,686,701 | B1 | 2/2004 | Fullarton |
| 6,690,120 | B2 | 2/2004 | Oskorep et al. |
| 2002/0129524 | A1 | 9/2002 | Haines |
| 2004/0066148 | A1 | 4/2004 | Oskorep |
| 2004/0150994 | A1 | 8/2004 | Kazar |
| 2005/0040772 | A1 | 2/2005 | Guzman |
| 2005/0047132 | A1 | 3/2005 | Dowling |

FOREIGN PATENT DOCUMENTS

| | | |
|---|---|---|
| WO | WO 99/31560 | 6/1999 |
| WO | WO 02/069306 A2 | 9/2002 |
| WO | WO 02/098182 A2 | 12/2002 |
| WO | WO 03/026358 A1 | 3/2003 |
| WO | WO 03/055273 A2 | 7/2003 |
| WO | WO 03/067934 | 8/2003 |

OTHER PUBLICATIONS

Guerrero, Lucio; "Lights go up, never come down"; Chicago Sun-Times; Wednesday Dec. 3, 2003; p. 14, vol. 56, No. 258, Chicago Sun-Times Inc.; Chicago, IL, USA.

Mullins, Michelle; "No-fuss lighting"; Daily Southtowner; Thursday, Dec. 4, 2003; pp. B1 & B6, vol. 26, No. 282, Midwest Suburban Publishing; Chicago, IL, USA.

U.S. Appl. No. 10/144,149, Oskorep et al; Entitled "Year-Round Decorative Lights With Selectable Holiday Color Schemes".

Select pages from www.colorkinetics.com of Color Kinetics, Inc.; published at least as of Dec. 17, 2003.

Reardon, Patrick T., "When It comes to expressing civic pride or public spirit it's hard to top a Skyscraper", Chicago Tribune, Thursday Apr. 29, 2004, pp. 1 and 4, Section 5, Chicago Tribune.

| 114 | | | 116 | | | 118 | | | ... |
|---|---|---|---|---|---|---|---|---|---|
| L1 | L2 | L3 | L1 | L2 | L3 | L1 | L2 | L3 | |
| | | | | | | | | | OFF |
| | W | | | W | | | W | | NEW YEAR'S |
| R | W | | R | W | | R | W | | VALENTINES/SWEET |
| R | W | B | R | W | B | R | W | B | JULY4/MEMORIAL |
| O | W | | O | W | | O | W | | HALLOWEEN |
| O | | G | O | | G | O | | G | THANKSGIVING |
| R | | G | R | | G | R | | G | XMAS |
| | W | B | | W | B | | W | B | HANUKKAH |
| R | W | G | R | W | G | R | W | G | CINCO DE MAYO |
| O | W | G | O | W | G | O | W | G | ST. PATRICK'S |

102

400

YEAR-ROUND DECORATIVE LIGHTS WITH MULTIPLE STRINGS OF SERIES-COUPLED BIPOLAR BICOLOR LEDS FOR SELECTABLE HOLIDAY COLOR SCHEMES

CROSS-REFERENCE TO RELATED APPLICATIONS

This application is a continuation-in-part of U.S. patent application Ser. No. 10/678,934 filed on Oct. 3rd, 2003 now U.S. Pat. No. 6,933,680 entitled "Decorative Lights With At Least One Commonly Controlled Set Of Color-Controllable LEDs For Selectable Holiday Color Schemes", which is a continuation-in-part of U.S. patent application Ser. No. 10/144,149 filed on May 10th, 2002 entitled "Year-Round Decorative Lights With Selectable Holiday Color Schemes", now U.S. Pat. No. 6,690,120, each application of which is hereby incorporated by reference herein.

BACKGROUND

1. Field of the Technology

The present invention relates generally to decorative lights such as decorative holiday lights (e.g. Christmas lights), and more particularly to decorative light strands with multiple strings of series-coupled, bipolar, bicolor light-emitting diodes (LEDs).

2. Description of the Related Art

Conventional decorative lights are typically fixed in color and celebratory purpose. One type of conventional light strand includes a plurality of lights which have the same single color (e.g. all white or all red). Another conventional light strand includes a plurality of lights which are multi-color (e.g. red, green, white, blue, and yellow) and lit all at the same time. Many of these lights are suitably colored for the Christmas holidays; e.g. solid red and green, although other multi-color combinations are popular. Some light strands provide for a "flashing" or "blinking" of lights in a random or set fashion. An end-user of Christmas lights typically hangs one or more light strands for the holiday (indoors or outdoors), and takes them down and puts them into storage after the holiday is over.

Holidays other than Christmas are celebrated as well, although light strands for these occasions are difficult to find if they even exist at all. For Independence Day and Memorial Day, the color combination of red, white, and blue is popular. For Hanukkah, the colors of blue and gold are popular. For Halloween, the color combination of orange and yellow is popular. For these and other celebrated holidays, an individual often purchases different decorations just before the holiday and hangs them up. For other occasions, such as parties, birthdays, anniversaries, showers, graduations, etc., one typically has to purchase other suitable decorations and decorate with them. These decorative items are hung up for the occasion and thereafter taken down.

Prior art related to the present application includes a Christmas light strand (manufacturer unknown) which has a button switch for providing eight (8) different lighting variations. The light strand has four (4) different colored lights in the following repeated sequence: red, green, orange, and blue. The lighting variations are described as follows: 1—"COMBINATION; 2—"IN WAVES"; 3—"TWINKLE/FLASH"; 4—"SLO-GLO"; 5—"SEQUENTIAL"; 6—"SLOW FADE"; 7—"CHASING/FLASH"; AND 8—"STEADY ON". For the 2nd, 3rd, 5th, and 7th settings, somewhat random flashing of all of the colors are provided in subtle variations. For the 4th and 6th settings, fading in and out of all of the colors (in sequence and simultaneously, respectively) are provided. All colors are lit solid in the 8th setting. Finally, the 1st setting sequences through the 1st through 7th settings. This light strand and its settings are designed solely for Christmas; no different color schemes or holiday schemes are provided. The above-described light strand is representative of such user-controllable time-sequenced lights which are suitable for Christmas or commercial applications.

The present invention relates to a "year-round" decorative light strand which provides for different color schemes which are selectable by the end user with use of a decorating selector/switch. The different color schemes include U.S. holiday color schemes for year-round usage. Patent applications related to such a year-round decorative light strand include U.S. Pat. No. 6,690,120 filed on 10 May 2002 entitled "Year-Round Decorative Lights With Selectable Holiday Color Schemes"; U.S. patent application Ser. No. 10/678,934 filed on Oct. 3rd 2003 entitled "Decorative Lights With At Least One Commonly Controlled Set Of Color-Controllable Multi-Color LEDs For Selectable Holiday Color Schemes"; U.S. patent application Ser. No. 10/758,143 filed on 15 Jan. 2004 entitled "Year-Round Decorative Lights With Addressable Color-Controllable LED Nodes For Selectable Holiday Color Schemes"; and U.S. patent application Ser. No. 10/763,658 filed on 23 Jan. 2004 entitled "Year-Round Decorative Lights With Time-Multiplexed Illumination Of Interleaved Sets Of Color-Controllable LEDs".

In a color-scheme-controllable light strand, the number of wired lines along the light strand may be relatively large depending on the specific implementation. In addition, there may be unattractive non-lit bulbs along the light strand in at least some selected color schemes. Further, there may be a consumer expectation that the light strand have an increased life of use based on the year-round color scheme features that it provides. Cost is another important factor. Finally, although such a light strand provides for different color schemes, there may be limitations on which particular colors are utilized (e.g. uncommon colors such as purple or pink may not be provided).

Accordingly, what is needed is a decorative lighting apparatus which overcomes the deficiencies of the prior art.

SUMMARY

A decorative lighting apparatus provides user-selectable color schemes corresponding to several holidays, and other occasions and themes, for year-round use. In one illustrative example of the present invention, a decorative lighting apparatus includes a decorative light strand having a first wire with a first plurality of lamps coupled in series therealong, a second wire with a second plurality of lamps coupled in series therealong, a third wire with a third plurality of lamps coupled in series therealong, and a return wire coupled to ends of the first, the second, and the third wires. Each lamp of the first plurality has a first light-emitting diode (LED) device (e.g. red) which is coupled in parallel and in reverse orientation with a second LED device (e.g. orange/yellow), each lamp of the second plurality has a third LED device (e.g. blue) which is coupled in parallel and in reverse orientation with a fourth LED device (e.g. green), and each lamp of the third plurality has at least a fifth light-emitting diode (LED) device (e.g. white). Preferably, each lamp of the first and the second pluralities is a two-leaded bipolar, bicolor LED. The first, the second, and the third wires are positioned together such that each lamp of the first, the second, and the third pluralities are positioned adjacent to each other but sufficiently separated such that little or no color mixing occurs between the lamps.

A controller includes a first output for controlling an illumination of a color in the first plurality of lamps along the first wire, a second output for controlling an illumination of a color in the second plurality of lamps along the second wire, and a third output for controlling an illumination of a color in the third plurality of lamps along the third wire. The decorative light strand also includes a decorating selector which provides for a plurality of user-selectable switch settings. The controller is adapted to control the first, the second, and the third outputs to provide a different color scheme in the first, the second, and the third pluralities of lamps for each user-selectable switch setting of the decorating selector. Some of the different color schemes consist of two colors which are simultaneously illuminated along the decorative light strand, and other color schemes consist of three colors which are simultaneously illuminated along the decorative light strand.

Advantageously, the decorative light strand may be hung permanently and utilized year-round for major holidays as well as for other suitable themes and occasions. In a color-scheme-controllable light strand, the use of such LEDs as described provides for flexibility in the choice of colors through use of color setting techniques, reduces the number of (or eliminates) non-lit lamps for many color schemes, provides the light strand with a long-life which is especially desirable in a year-round application, and reduces the number of wired lines to the lamps.

DETAILED DESCRIPTION OF THE PREFERRED EMBODIMENTS

A decorative lighting apparatus provides user-selectable color schemes corresponding to several holidays, and other occasions and themes, for year-round use. In one illustrative example, a decorative lighting apparatus includes a decorative light strand having a first wire with a first plurality of lamps coupled in series therealong, a second wire with a second plurality of lamps coupled in series therealong, a third wire with a third plurality of lamps coupled in series therealong, and a return wire coupled to ends of the first, the second, and the third wires. Each lamp of the first plurality has a first light-emitting diode (LED) device (e.g. red) which is coupled in parallel and in reverse orientation with a second LED device (e.g. orange/yellow), each lamp of the second plurality has a third LED device (e.g. blue) which is coupled in parallel and in reverse orientation with a fourth LED device (e.g. green), and each lamp of the third plurality has at least a fifth light-emitting diode (LED) device (e.g. white). Preferably, each lamp of the first and the second pluralities is a two-leaded bipolar, bicolor LED. The first, the second, and the third wires are positioned together such that each lamp of the first, the second, and the third pluralities are positioned adjacent to each other but sufficiently separated such that little or no color mixing occurs between the lamps. A controller of the decorative lighting apparatus includes a first output for controlling an illumination of a color in the first plurality of lamps along the first wire, a second output for controlling an illumination of a color in the second plurality of lamps along the second wire, and a third output for controlling an illumination of a color in the third plurality of lamps along the third wire. The decorative light strand also includes a decorating selector which provides for a plurality of user-selectable switch settings. The controller is adapted to control the first, the second, and the third outputs to provide a different color scheme in the first, the second, and the third pluralities of lamps for each user-selectable switch setting of the decorating selector. Some of the different color schemes consist of two colors which are simultaneously illuminated along the decorative light strand, and other color schemes consist of three colors which are simultaneously illuminated along the decorative light strand. Preferably, the different color schemes include holiday color schemes for year-round use of the decorative lighting apparatus.

Figure 1:
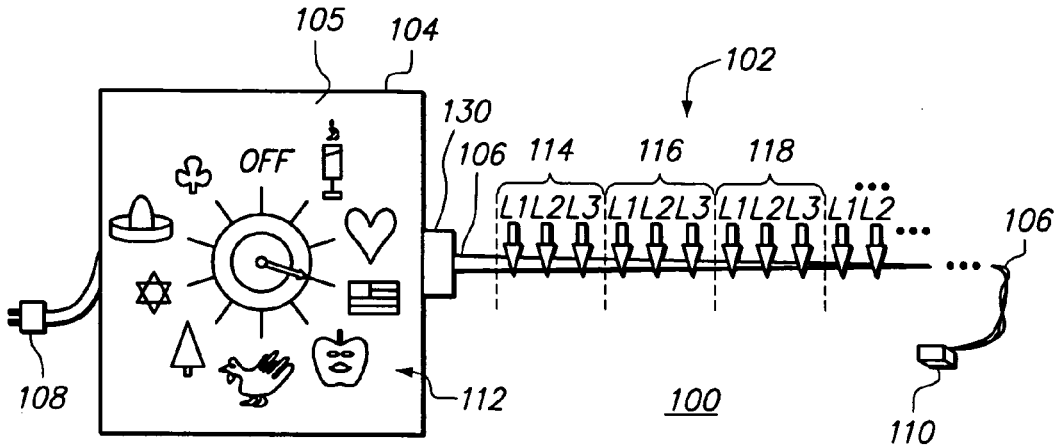
FIG. 1 is an illustration of a decorative lighting apparatus which includes a representative arrangement of lamps along a decorative light strand as well as a decorating selector.

FIG. 1 is an illustration of a decorative lighting apparatus 100 which includes an arrangement of lamps 102 along a decorative light strand and a decorating selector 104. In general, when decorative lighting apparatus 100 is plugged in and turned on, a plurality of electrically insulated wires 106 are controlled electronically to illuminate lamps 102 with particular color schemes depending on the user switch setting from decorating selector 104.

Decorating selector 104 includes a housing 105 and a switch 112 which provides for a plurality of color scheme settings. Housing 105 is a small, relatively light-weight housing, preferably mostly of plastic construction, which is sized to be held in a human hand. In this embodiment, switch 112 is a 10-position rotary switch, single-throw. However, the number of positions of switch 112 may be more or less depending on how many decorative settings are desired. In an alternative embodiment, switch 112 is a conventional push-button switch which provides the plurality of different settings sequentially when pressing the button. Other alternative switches may be utilized, such as the switches shown and described later in relation to FIGS. 9 and 10. As an alternative or added feature, the decorative lighting apparatus may utilize a wireless remote control device for selecting one of the desired color schemes. In this case, a wireless receiver with antenna is contained within housing 105 for receiving a wireless signal from the wireless remote control device.

Attached to decorating selector 104 is a conventional AC power cord and plug 108 for connecting to a conventional AC outlet for supplying power to illuminate lamps 102. A power supply (which may include a transformer and/or rectifier, for example) may be included within housing 105 for AC-to-DC conversion for logic/control circuitry (not shown in FIG. 1). Alternatively, the power supply may not be an integral component of decorative lighting apparatus 100 but rather a separate off-the-shelf power supply which interfaces with decorative lighting apparatus 100. Also in FIG. 1, a male connecting plug 130 is attached at the front end of wires 106 and a female connecting socket 110 is attached at the rear end of wires 106. Male connecting plug 130 mates with a female connecting socket provided on housing 105, which is the same type as female connecting socket 110. Female connecting socket 110 may be provided so that additional lamps of the same type may be added to the lighting strand and controlled by the same decorating selector 104. With the configuration provided in FIG. 1, decorating selector 104 and the decorative light strand may be separate and independent devices and sold separately from one another.

Each one of lamps 102 is contained within a socket, includes a lamp dome, and provides a single source of light along the decorative light strand. Lamps 102 are designated in a sequence of $L_1$, $L_2$, and $L_3$ along a light strand portion 114 as shown in FIG. 1, and this is repeated a plurality of times along wires 106 in a following representative light strand portion 116 and yet again in another following representative light strand portion 118. Those lamps having the same lamp designations (e.g. all $L_1$ lamps or all $L_3$ lamps) are of the same type and construction, and lamps having different lamp designations (e.g. all $L_1$ lamps compared to all $L_3$ lamps) are of a different type and construction. Each lamp 102 may be physically spaced apart from an adjacent lamp by a fixed predetermined distance (e.g. between about 1–13 centimeters). Alternatively, each grouping of $L_1$, $L_2$, and $L_3$ lamps are provided together in a vertical alignment or positioned close together (e.g. together within a range of about 2–5 centimeters) where a larger spacing (e.g. about 5–13 centimeters) is provided between each separation of $L_3$ and $L_1$. Here, each $L_1$, $L_2$, and $L_3$ grouping of lamps provides a single location of multiple light colors (i.e. each grouping of $L_1$, $L_2$, and $L_3$ lamps are collocated) along the decorative light strand. In any case, lamps $L_1$, $L_2$, and $L_3$ are positioned adjacent to each other along the strand but sufficiently separated such that little or no color mixing occurs between the lamps.

Figures 4, 5:
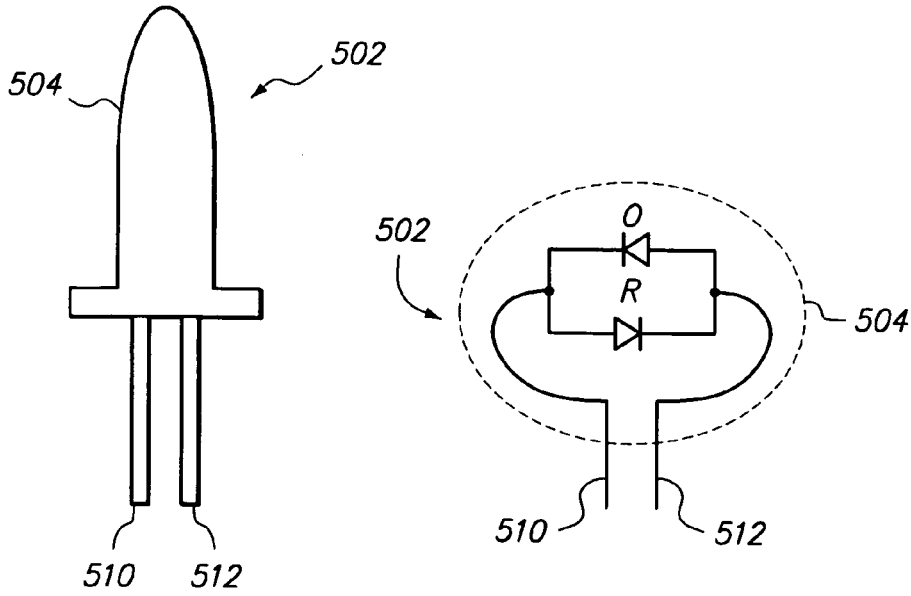
FIG. 4 is a color/lamp enabling scheme for the representative arrangement of lamps.
FIG. 5 is an illustration of a preferred color-controllable lamp for use in connection with the present invention, namely a bicolor bipolar light-emitting diode (LED), each lamp having a first LED device which is coupled in parallel and in reverse orientation with a second LED device.

In the present application, lamps 102 are light-emitting diodes (LEDs). More specifically, lamps 102 may be or include two-terminal, bipolar, bicolor LEDs. Referring ahead to FIG. 5, a lamp 502 of a two-terminal, bipolar, bicolor LED type is illustrated. Referring to its internal structure, lamp 502 includes a first LED device of a first color and a second LED device of a second color which is coupled in parallel and in reverse orientation with the first LED device. The first and the second LED devices are contained within a lamp dome 504 in this arrangement, where a first terminal 510 and a second terminal 512 of lamp 502 extend therefrom. The lamp (i.e. the bicolor LED) is mounted within a socket which is fixed along the decorative light strand, where the LED is coupled in series along the wire. When first and second terminals 510 and 512 are forward-biased (i.e. a positive voltage reference at terminal 510 and a negative voltage reference at terminal 512), lamp 502 is illuminated with the first color of the first LED device. When first and second terminals 510 and 512 are reversed-biased (i.e. negative voltage reference at terminal 510 and positive voltage reference at terminal 512), lamp 502 is illuminated with the second color of the second LED device. As described in more detail herein, color setting and/or mixing techniques are performed by logic/control circuitry to produce different colors within the same lamp having the bicolor LED. In particular, which is described further below, an AC power source is controlled by control circuitry such that at least portions of positive half-cycles of an AC waveform drives the first LED devices of the bicolor LED and at least portions of negative half-cycles of the AC waveform drive the second LED devices of the bicolor LED.

Figure 2:
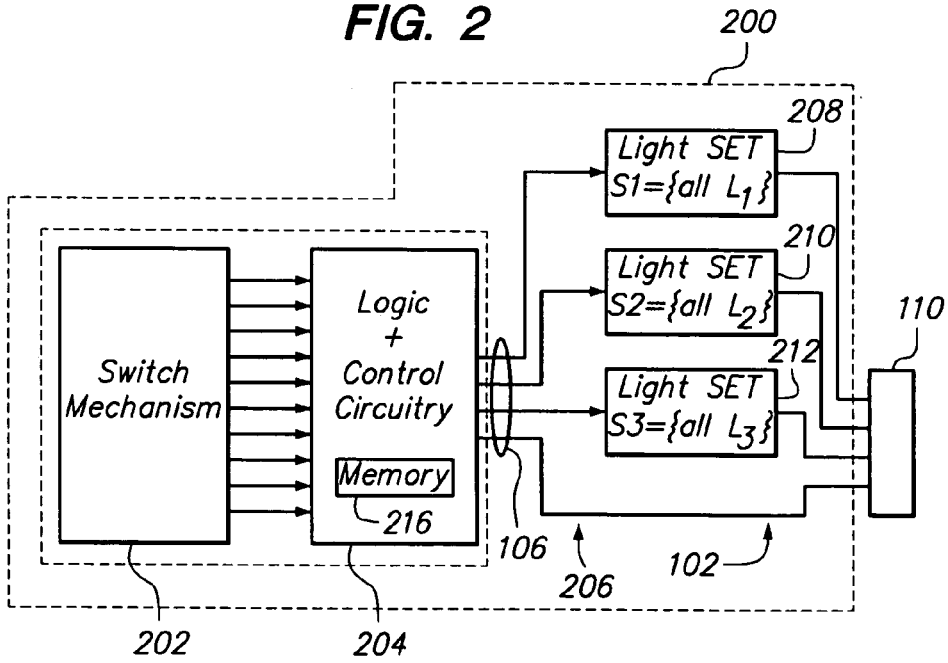
FIG. 2 is a schematic block diagram of electronics for the decorative lighting apparatus of FIG. 1.

FIG. 2 is a schematic block diagram of basic electronics 200 for decorative lighting apparatus 100 of FIG. 1. Electronics 200 of FIG. 2 include a switch mechanism 202, logic/control circuitry 204 which includes memory 216, and color-controllable lamps 102. As shown in FIG. 1, switch 112 is visibly exposed outside housing 105 whereas the electronics of switch mechanism 202 (FIG. 2) are contained within housing 105. In the present embodiment, switch mechanism 202 has a plurality of logic outputs which change signal level based on the position of switch 112 (FIG. 1). Logic/control circuitry 204 is operative to read the signals from switch mechanism 202 and illuminate lamps 102 accordingly. Logic/control circuitry 204 is contained within the housing and includes additional circuits (not shown in FIG. 2) for driving lamps 102. Logic/control circuitry 204 may include a controller, a processor, logic gates, or combinations thereof. Preferably, logic/control circuitry 204 includes a microprocessor or microcontroller which is programmed with embedded software to perform functions described herein. Memory 216 is preprogrammed to store data corresponding to all or a limited subset of the color schemes described herein.

As illustrated, all $L_1$ lamps are logically grouped into a set $S_1$ (i.e. set 208); all $L_2$ lamps are logically grouped into a set $S_2$ (i.e. set 210); and all $L_3$ lamps are logically grouped into a set $S_3$ (i.e. set 212). As apparent from FIGS. 1–2, the wires are positioned together such that each lamp in each set $S_1$, $S_2$, and $S_3$ is interleaved with lamps of other sets along the decorative light strand. Also, lamps in each set $S_1$, $S_2$, and $S_3$ are commonly-controlled by logic/control circuitry 204, separately and independently from other sets, to have the same color and intensity at any given time. Thus, lamps 102 include different sets $S_1$, $S_2$, and $S_3$ of independently color-controllable lamps. Although three (3) sets of independently controllable lamps are utilized in the present embodiment, any suitable number of two sets (2) or greater may be utilized.

Preferably, the color schemes provided by the decorative lighting apparatus include holiday color schemes corresponding to most major U.S. holidays. As apparent from the icons provided on housing 105 of FIG. 1 (via a plastic overlay adhesively attached on the housing), the holiday color scheme settings include (in clockwise order) a New Year's holiday setting, a Valentines/Sweetest Day holiday setting, an Independence/Memorial Day holiday setting, a Halloween holiday setting, a Thanksgiving holiday setting, a Christmas holiday setting, a Hanukkah holiday setting, a Cinco De Mayo setting, and a St. Patrick's Day setting. These are merely examples and may vary. Advantageously, this strand of decorative lights can be permanently hung and utilized year-round for major holidays and/or other suitable occasions.

In one illustrative example, the New Year's holiday setting illuminates only white colors in lamps 102 ($L_1$=off; $L_2$=white; $L_3$=off); the Valentines/Sweetest Day holiday setting illuminates only red and white colors (repeating sequence) in lamps 102 ($L_1$=red; $L_2$=white; $L_3$=off); the Independence/Memorial Day holiday setting illuminates only red, white, and blue colors (repeating sequence) in lamps 102 ($L_1$=red; $L_2$=white; $L_3$=blue); the Halloween holiday setting illuminates only orange and white colors in lamps 102 ($L_1$=orange; $L_2$=orange; $L_3$=off); the Thanksgiving holiday setting illuminates only orange and green colors (repeating sequence) in lamps 102 ($L_1$=orange; $L_2$=off; $L_3$=green); the Christmas holiday setting illuminates only red and green colors (repeating sequence) in lamps 102 ($L_1$=red; $L_2$=off; $L_3$=green); the Hanukkah holiday setting illuminates only blue and white colors (repeating sequence) in lamps 102 ($L_1$=blue; $L_2$=gold; $L_3$=blue; $L_4$=gold); the Cinco De Mayo setting illuminates only red, white, and green colors (repeating sequence) in lamps 102 ($L_1$=red; $L_2$=white; $L_3$=green); and the St. Patrick's setting illuminates only orange (optional), white, and green colors (repeating sequence) in lamps 102 ($L_1$=orange or off; $L_2$=white; $L_3$=green). Many other alternative and additional color schemes may be provided.

Figure 3A:
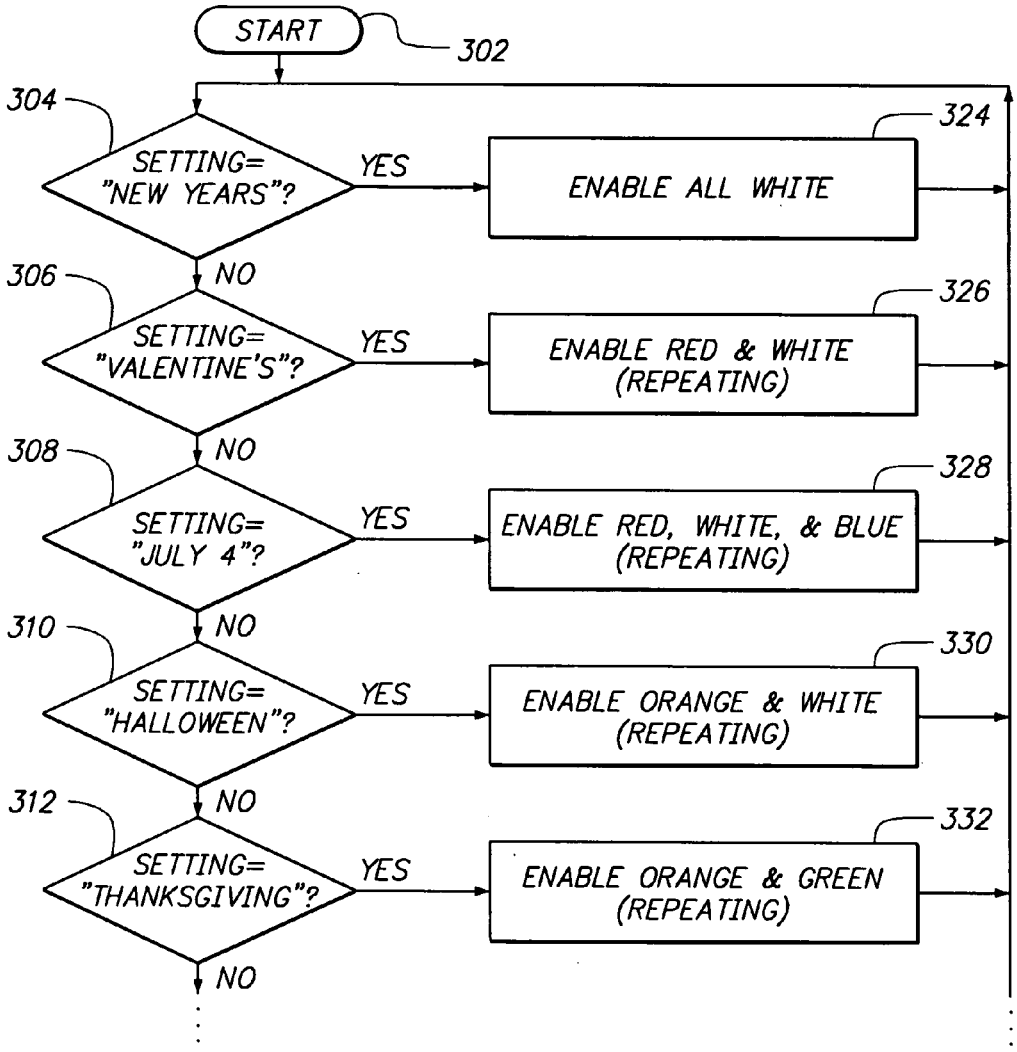
FIGS. 3A & 3B form a flowchart which describes a method of selecting color schemes with the decorative lighting apparatus of FIGS. 1 and 2.
Figure 3B:
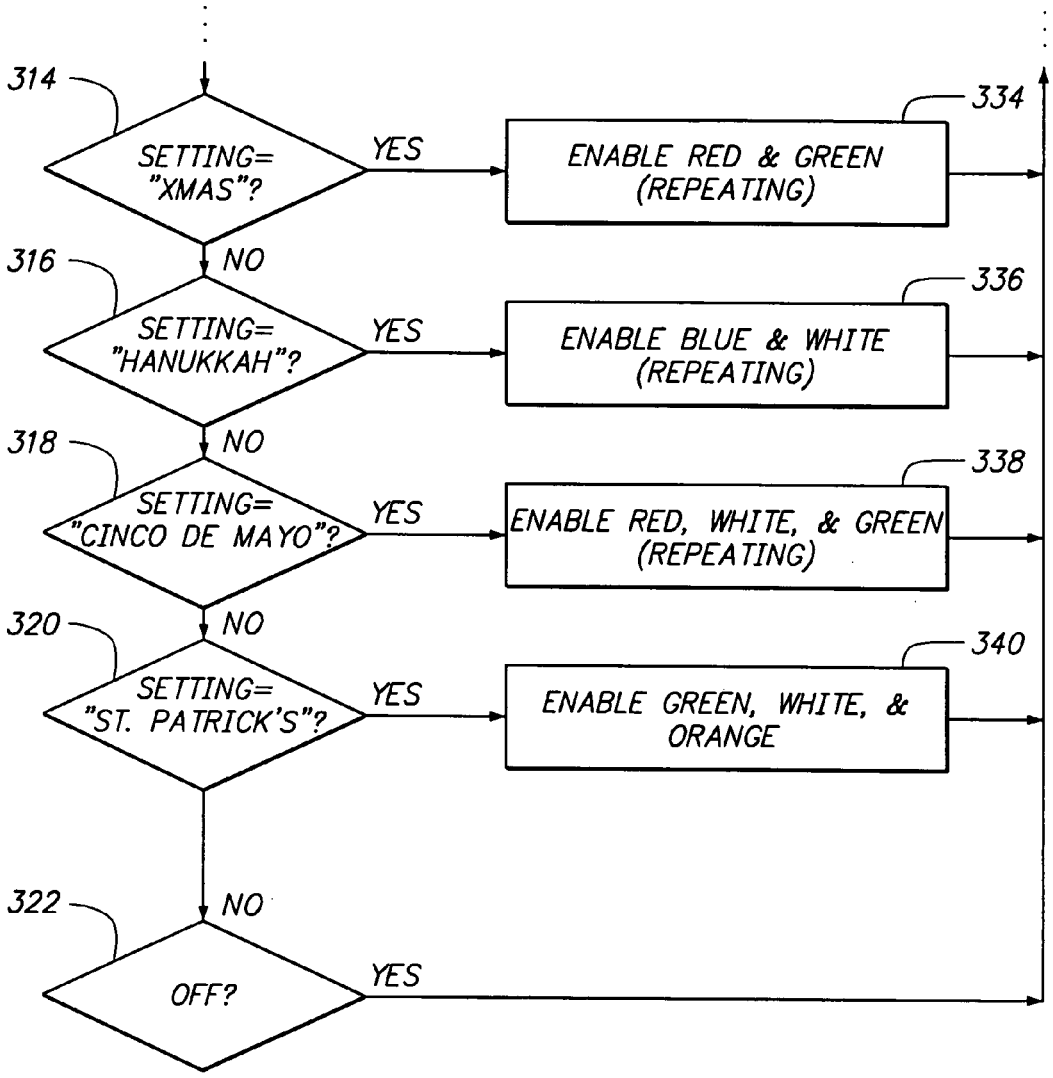

FIG. 3 is a flowchart which describes a method of selecting holiday color schemes using the decorative lighting apparatus 100 of FIG. 1. Beginning at a start block 302 in FIG. 3, if the switch setting is detected to be "New Year's" (step 304 of FIG. 3), then the logic/control circuitry enables white colors only (step 324 of FIG. 3). If the switch setting is detected to be "Valentines/Sweetest Day" (step 306 of FIG. 3), then the logic/control circuitry enables red and white colors only (step 326 of FIG. 3). If the switch setting is detected to be "July 4/Memorial Day" (step 308 of FIG. 3), then the logic/control circuitry enables red, white, and blue colors only (step 328 of FIG. 3). If the switch setting is detected to be "Halloween" (step 310 of FIG. 3), then the logic/control circuitry enables orange and white colors only (step 330 of FIG. 3). If the switch setting is detected to be "Thanksgiving" (step 312 of FIG. 3), then the logic/control circuitry enables orange and green colors only (step 332 of FIG. 3). If the switch setting is detected to be "Christmas" (step 314 of FIG. 3), then the logic/control circuitry enables red and green colors only (step 334 of FIG. 3). If the switch setting is detected to be "Hanukkah" (step 316 of FIG. 3), then the logic/control circuitry enables blue and white colors only (step 336 of FIG. 3). If the switch setting is detected to be "Cinco De Mayo" (step 318 of FIG. 3), then the logic enables red, white, and green colors only (step 338 of FIG. 3). If the switch setting is detected to be "St. Patrick's" (step 320 of FIG. 3), then the logic enables orange, white, and green colors only (or white and green colors only) (step 340 of FIG. 3). Preferably, two different St. Patrick's Day options are provided: orange, white, and green, as well as white and green. If the switch setting is detected to be "Off" (step 322 of FIG. 3), then no lamps are enabled. The switch setting is continuously monitored so that, when set differently, the appropriate decorating lighting scheme is displayed.

In FIG. 4, a light arrangement table 400 which shows the color/light enabling scheme in lamps 102. This figure illustrates more clearly how the decorating lighting apparatus may appear when particular color schemes are selected. A letter code in the table 400 indicates which particular color is illuminated in the lamps: W=White; R=Red; B=Blue; O=Orange; G=Green; no letter code=OFF. Preferably, each color scheme provided for does not change over time and remains generally fixed in color(s). The colors in each color scheme are preferably simultaneously illuminated. Note that many of the color schemes have at least two different colors which are simultaneously illuminated along the decorative light strand, such as in a repeated color sequence. Other color schemes have three different colors which are simultaneously illuminated. However, the colors need not always be constantly illuminated or fixed in position; the colors may indeed be flashed or alternating in the decorative light strands in any suitable predictable or random fashion.

Note that other suitable color schemes may be provided and the above are merely examples. Preferably, other holidays and occasions are provided for as well, including Mardi Gras (purple, green, and orange colors). In addition, additional settings correspond to a simple single-color illumination along the entire light strand for each primary and secondary color. Further, additional color schemes corresponding to holidays or occasions suitable in other countries (non-U.S. countries) may be provided. The settings may be suitable for providing a plurality of different geographical regional color schemes such as different flag colors for different states (U.S. states such as Arizona, Colorado, Maine, etc.) or countries (e.g. France, Japan, Italy, China, etc.) or different holiday schemes for a non-U.S. country or countries. Note that some holiday color schemes correspond to and are the same as some national flag color schemes (e.g. Italy and Mexico flag colors are the same as some Cinco De Mayo; Poland and Japan flag colors are the same as Valentine's Day). Even more additional settings provide color schemes which correspond to a plurality of different sports teams such as different football teams (e.g. Chicago Bears, New York Giants, San Diego Chargers, etc.), baseball teams, soccer teams, hockey teams, etc.

Figure 6:
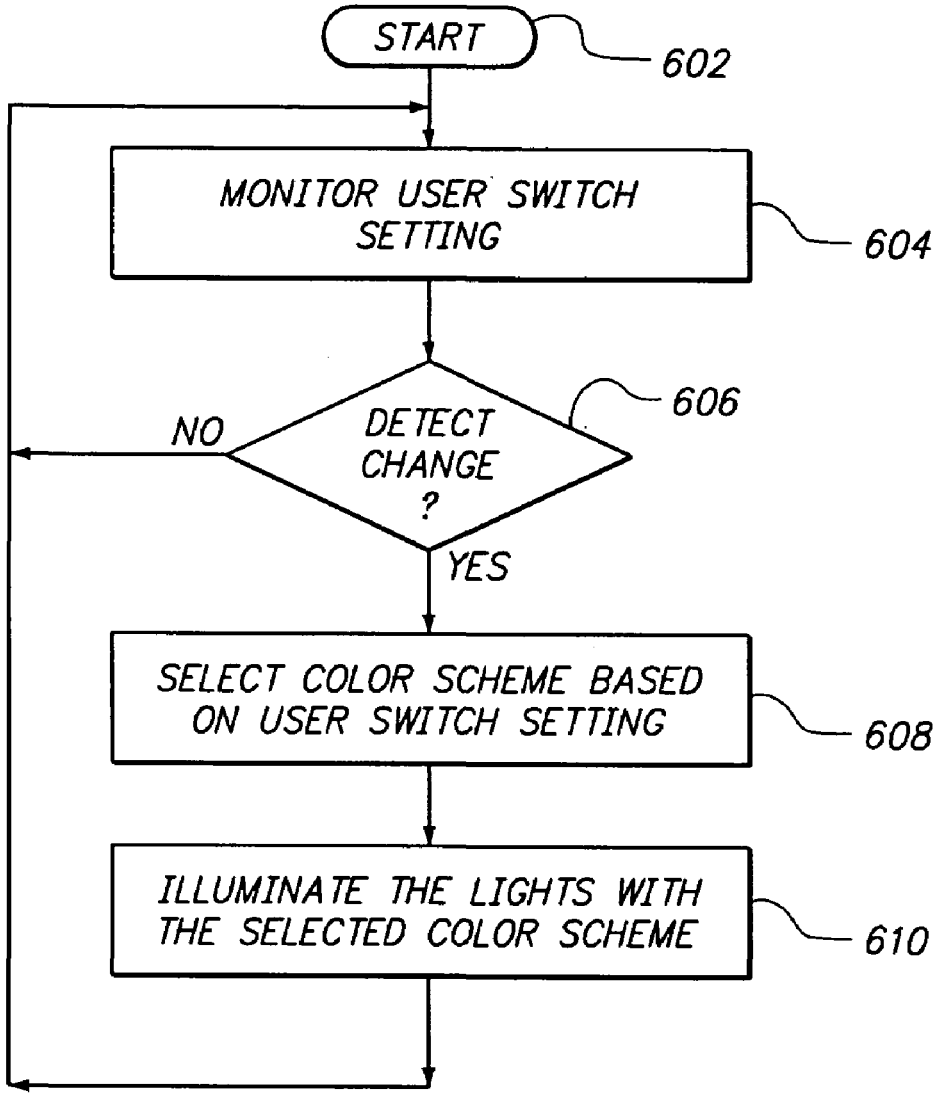
FIG. 6 is a flowchart which describes a general method of providing control in a decorative lighting apparatus for user-selectable color schemes according to the present invention.

Referring now to FIG. 6, a flowchart which describes an operating method of the logic/control circuitry 204 for user-selectable color schemes is provided. Beginning at a start block 602 of FIG. 6, user switch settings of the decorating selector or switch are monitored (step 604 of FIG. 6). If no change in the user switch setting is identified (step 606 of FIG. 6), then monitoring of the user switch settings are continued at step 604. If a change in the user switch setting is identified (step 606 of FIG. 6), then color scheme data corresponding to the user switch setting are identified or selected from memory (step 608 of FIG. 6). The color scheme data include color data for each different light set (e.g. each set $S_1$, $S_2$, and $S_3$). Preferably, the color data are stored in memory in association with a corresponding light set identification, and are appropriately selected based on the user switch setting. The lamps are then illuminated with the selected color scheme (step 610 of FIG. 6). The color scheme remains illuminated along the decorative light strand until the next color scheme is selected, where the method repeats at step 604.

Also preferably, the memory stores a single one-to-one light-set-to-color-data relationship for each color scheme. If three different lamp sets are utilized (, for example, then at most each color scheme has three color data items associated with three different lamp sets. It is preferred that the colors in each color scheme remain substantially the same over time. Alternatively, the colors may be flashed or alternated over time. Instead of providing additional light-set-to-color-data in memory for any "effects" in each color scheme, such effects are provided by utilizing common software algorithms which may be used for some if not all color schemes. Such a software algorithm utilizes the same color data as provided in the light-set-to-color data relationship to maintain color-consistency with the selected color scheme. One software algorithm may provide for a predictable "flashing" of the color scheme; in this case some or all of the lamps are repeatedly controlled from ON-to-OFF by sending appropriate data to them at an appropriate time. Another software algorithm may provide for a "random sparkling" of the color scheme; in this case some LED nodes selected by random-number generation are controlled from ON-to-OFF or lower intensity repeatedly by controlling them at an appropriate time.

The software which is programmed to cause the color schemes to be illuminated in response to user switch settings may be stored in read-only memory (ROM) in a "hard-coded" fashion, whereas the data to provide the color schemes may be stored in an erasable and/or rewritable memory such as an electrically erasable/programmable ROM (EEPROM) or FLASH memory. Thus, from product to product, the hardcoded software in ROM need not be different or ever change if the microprocessor is provided or utilized with a reprogrammable memory in which the color scheme data is stored. This approach is particularly advantageous so that a variety of different product lines that differ only by pre-programmed color scheme data (and e.g. a plastic icon overlay or other color scheme indication) may be easily manufactured. Alternatively, the programmed software and color scheme data may be stored in the same memory (e.g. both in FLASH memory).

Figure 7:
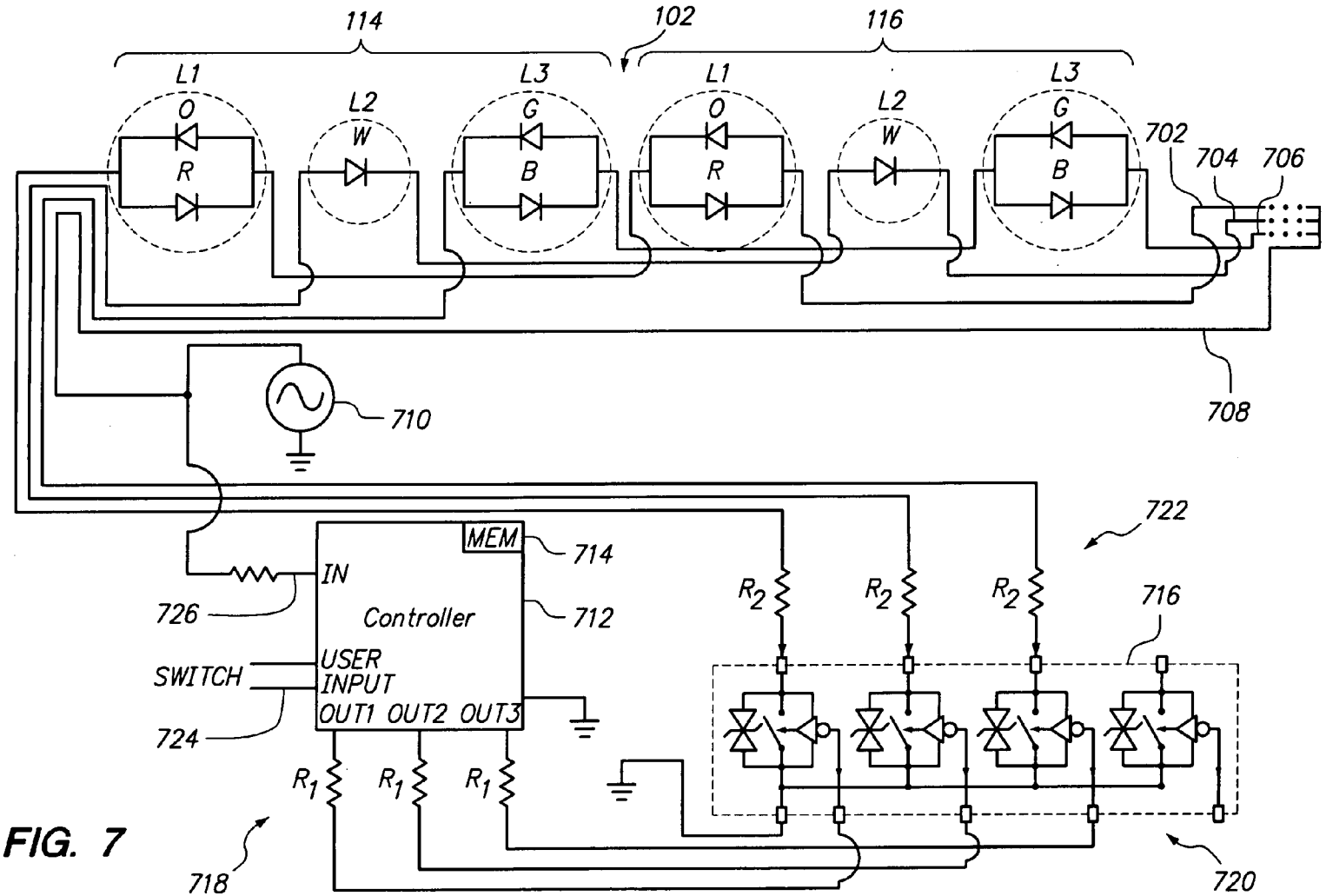
FIG. 7 is a schematic diagram of control circuitry for use with the representative arrangement of color-controllable lamps along the decorative light strand.

FIG. 7 is a more detailed schematic diagram of one example of a circuit and light configuration which may be used for that shown and described in relation to FIGS. 1–6. The circuitry of FIG. 7 includes lamps 102 along the decorative light strand, a controller 712, an AC power source 710, and an integrated circuit 716 having a plurality of AC line switches. In general, the circuitry performs two major functions: (1) a high-level function of selecting a different color scheme based on the detection of a particular user switch setting; and (2) the low-level function of illuminating the lamps 102 with the selected color scheme.

The decorative light strand of FIG. 7 is shown to have a first wire 702 with a first plurality of lamps (L1) coupled in series therealong, a second wire 704 with a second plurality of lamps (L2) coupled in series therealong, a third wire 706 with a third plurality of lamps (L3) coupled in series therealong, and a return wire 708 coupled to common ends of the first, the second, and the third wires 702, 704, and 706. Each lamp of the first plurality (L1 lamps) along first wire 702 is or includes a first light-emitting diode (LED) device which is coupled in parallel and in reverse orientation with a second LED device. Each lamp of the third plurality (L3 lamps) along third wire 706 is or includes a third LED device which is coupled in parallel and in reverse orientation with a fourth LED device. Each lamp of the second plurality (L2 lamps) along second wire 704 is or includes at least a fifth LED device.

Preferably, each L1 lamp is a two-terminal, bipolar, bicolor LED having a first LED device which provides for the color red and a second LED device which provides for the color orange (or yellow); each L3 lamp is also a two-terminal, bipolar, bicolor LED having a first LED device which provides for the color blue and a second LED device which provides for the color green; and each L2 lamp is a fixed-color LED which provides for the color white. Specifically, the first LED device of each L1 lamp is red at about 630 nm and the second LED device of each L1 lamp is yellow at about 589 nm. Also, the third LED device of each L3 lamp is blue at about 470 nm and the fourth LED device of each L3 lamp is green at about 525 nm. Each L2 lamp is a fixed white LED; however where possible it may also be or include a bicolor LED (e.g. bipolar) which provides both a white and another color (e.g. yellow). More generally, each L1 lamp includes a first LED device having a first wavelength within a range of between 610–680 nanometers (nm) and the second LED device having a second wavelength different from the first wavelength within a range of between 570–640 nm. On the other hand, each L3 lamp includes a third LED device having a third wavelength within a range of between 420–480 nm and a fourth LED device having a fourth wavelength different from the third wavelength within a range of between 505–560 nm. However, the colors of the LEDs may vary as long as they provide for different colors from one another.

In FIG. 7, and as previously described in relation to FIGS. 1–2, all $L_1$ lamps may be logically grouped into a set $S_1$; all $L_2$ lamps are logically grouped into a set $S_2$; and all $L_3$ lamps are logically grouped into a set $S_3$. As apparent, wires 702, 704, and 706 are positioned together such that each lamp in each set $S_1$, $S_2$, and $S_3$ is interleaved with lamps of other sets along the decorative light strand. Also, lamps in each set $S_1$, $S_2$, and $S_3$ are commonly-controlled by circuitry, separately and independently from other sets, to have the same color and intensity at any given time. Thus, lamps 102 include different sets of independently color-controllable lamps. Although three (3) sets of independently controllable lamps are preferred, any suitable number of two sets (2) or greater may be utilized. Preferably, each lamp set $S_1$, $S_2$, and $S_3$ has the same number of lamps. For example, in this embodiment, each lamp set has thirty-five (35) lamps. Also in this embodiment, each L1 lamp provides for a voltage drop of about 2.5 volts; each L2 lamp provides for a voltage drop of about 3.6 volts; and each L3 lamp provides for a voltage drop of about 3.6 volts. Note that the number of lamps along the light strand may be selected as desired. Preferably, a number of lamps per set is first identified (e.g. based on aesthetic design) and thereafter the R2 resistance values are chosen so as to produce a voltage sufficient to illuminate each LED without damaging them.

As described earlier in relation to FIGS. 1–2, each lamp 102 may be physically spaced apart from an adjacent lamp by a fixed predetermined distance (e.g. between about 1–13 centimeters). Alternatively, each grouping of $L_1$, $L_2$, and $L_3$ lamps are provided together in a vertical alignment or positioned close together (e.g. together within a range of about 2–5 centimeters) where a larger spacing (e.g. about 5–13 centimeters) is provided between each separation of $L_3$ and $L_1$. Here, each $L_1$, $L_2$, and $L_3$ grouping of lamps provides a single location of multiple light colors (i.e. each grouping of $L_1$, $L_2$, and $L_3$ lamps are collocated) along the decorative light strand. In any case, first, second, and third wires 702, 704, and 706 (as well as return wire 708) are positioned together (bound, wrapped, aligned, etc.) such that each lamp of the first, the second, and the third pluralities are positioned adjacent to each other but sufficiently separated such that little or no color mixing occurs between lamps.

Controller 712 has one or more inputs 724 for receiving user switch settings from a switch (as described elsewhere in this document). Controller 712 monitors switch inputs from the switch mechanism (not shown in FIG. 7) and selects one of a plurality of color scheme data from memory 714 based on the switch setting. The switch inputs may be continuously monitored through scanning techniques or, alternatively, may be interrupt-driven. Controller 712 uses color scheme data to illuminate lamps 102 according to the selected color scheme. Controller 712 also has a plurality of logic outputs 718 which are coupled to a plurality of logic inputs 720 to the AC line switches through R1 resistors. In this embodiment, each R1 resistor has a resistance of about 150 ohms. IC package 716 with the AC line switches has the circuit configuration as shown in FIG. 7. IC package 716 has a plurality of outputs 722 from the AC line switches which are coupled to first ends of associated wires 702, 704, and 706, respectively, through R2 resistors. Each R2 resistor serves as part of a voltage divider to provide an appropriate voltage drop for each lamp set of each wire. In this embodiment, the R2 resistor for wire 702 (red-orange) has a resistance of about 4.3K ohms, the R2 resistor for wire 704 (white) has a resistance of about 1.7K ohms, and the R2 resistor for wire 706 (blue-green) has a resistance of about 1.7K ohms. Preferably, as apparent, at least some of the R2 resistors are different to accommodate for the different voltage drops in the different LED types.

AC power source 710, which may be of the 120 or 240 voltage type, has a first end ("high side") and a second end ("neutral side") coupled to a power converter 750. Power converter 750 is operative to convert an AC waveform from AC power source 710 into a regulated DC signal (e.g. −5 volts DC) for powering specific electrical circuitry of the apparatus (e.g. controller 712). Specifically, a $V_{SS}$ input of controller 712 is coupled to the regulated DC signal from power converter 750 and a $V_{DD}$ input of controller 712 is coupled to the neutral side. The high side of AC power source 710 is coupled to return line 708 of the light strand. The neutral side of AC power source 710 is coupled to first ends of wires 702, 704, and 706 through the AC line switches of IC package 716.

The AC line switches within IC package 716 provide for a switchable coupling between wires 702, 704, and 706 the second end ("neutral") of AC power source 710 if/when the corresponding switches are selectively closed by controller 712. The light arrangement is configured such that at least portions of positive half-cycles of the AC waveform drive forward-oriented LED devices and at least portions of negative half-cycles of the AC waveform drive reverse-oriented LED devices along the light strand. Controller 712 has an input 726 coupled to AC power source 710 for signal zero-crossing detection which provides a timing reference for controller 712 to enable/disable AC line switches. Using this timing reference, controller 712 selectively enables/disables AC power source 710 through the AC line switches at the appropriate times to provide the requested, selected color scheme. More specifically, controller 712 decides which outputs 718 to enable/disable, and when to enable/disable them, based on the color scheme data selected in accordance with the user switch setting. Exemplary color schemes have been shown and described earlier in relation to FIGS. 3–4 for this arrangement.

To provide for the simultaneous illumination of the colors blue and white, for example, controller 712 controls the AC line switches such that the AC power source 710 is inhibited through first wire 702 (i.e. it is off or disabled), at least portions of the positive half-cycles of the AC waveform are provided through second wire 704, and at least portions of only the negative half-cycles of the AC waveform are provided through third wire 706. As another example, to provide for the simultaneous illumination of the colors red, white, and green along the light strand, controller 712 controls the AC line switches such that at least portions of only positive half-cycles of the AC waveform are provided through first wire 702 (negative half-cycles are inhibited), at least portions of positive half-cycles of the AC waveform are provided through second wire 704, and at least portions of only negative half-cycles of the AC waveform are provided through third wire 706 (positive half-cycles are inhibited).

In one approach, a simple enabling/disabling of LED colors in the lamps is performed where no color-mixing within each lamp is utilized. In an alternative approach, more advanced enabling/disabling of LED colors in the lamps is performed where conventional color-mixing techniques are also utilized to create a number of different colors for other different color schemes.

Figure 8:
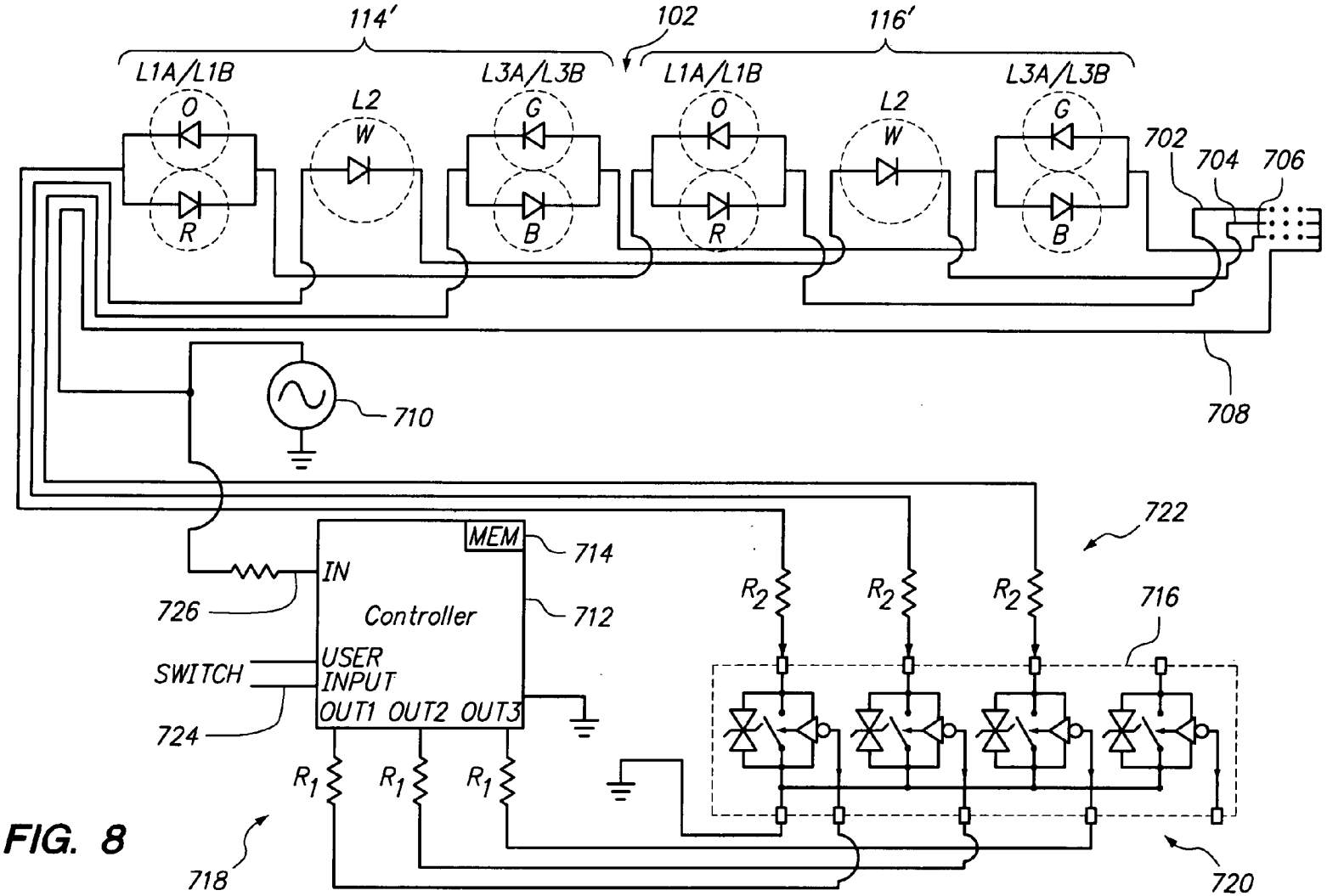
FIG. 8 is a schematic diagram of control circuitry for use with an alternative arrangement of color-controllable lamps along the decorative light strand.

FIG. 8 is a schematic diagram of another configuration which may be used in connection with the present invention. The diagram of FIG. 8 is the same as that shown in relation to FIG. 7, with the exception that lamps 102 having the bipolar, bicolor LEDs are not utilized. Lamps 102 are now substantially different and are all separate, two-leaded, fixed-color LEDs. As shown, L1 lamp is now two separate fixed-colored lamps L1A and L1B; L2 lamp is the same as before (FIG. 7); and L3 lamp is now two separate fixed-color lamps L3A and L3B. In particular, each L1A lamp is a two-leaded fixed color "red" LED; each LIB is a two-leaded fixed color "orange" (or "yellow") LED; each L2 lamp is a two-leaded fixed color "white" LED; each L3A is a two-leaded fixed color "blue" LED; and each L3B is a fixed color "green" LED. Although the first, the second, and the third wires 702, 704, and 706 are positioned together such that each lamp of the first, the second, and the third pluralities are positioned adjacent to each other, lamps 102 are still sufficiently separated such that little or no color mixing occurs between the lamps. No multicolored effects are utilized in this embodiment. This type of configuration is important to provide for various color schemes with different color combinations suitable for a year-round application. Also, there is a cost benefit as special or custom-made bicolor LEDs are typically more costly than fixed-colored LEDs.

Figure 9:
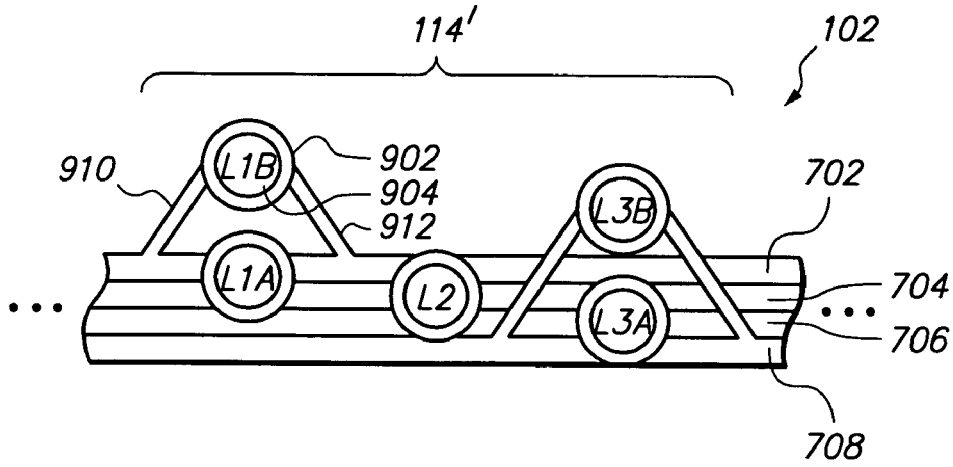
FIG. 9 is one embodiment of the lamp/socket arrangement for the configuration shown and described in relation to FIG. 8.
Figure 10:
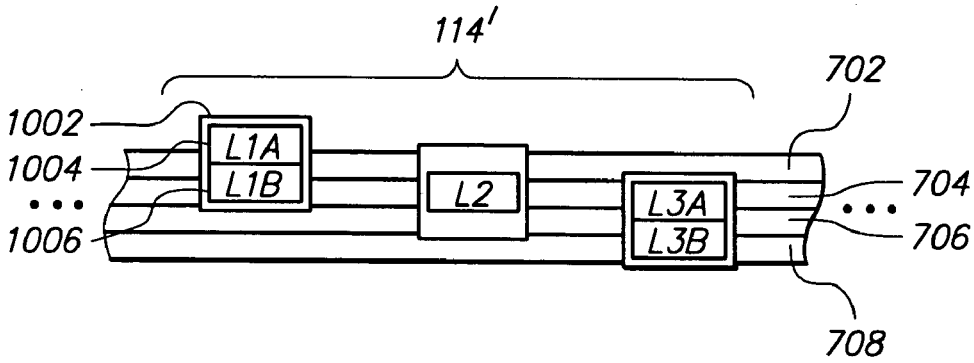
FIG. 10 is another embodiment of the lamp/socket arrangement for the configuration shown and described in relation to FIG. 8.

FIGS. 9 and 10 show two different ways in which the fixed-colored LEDs of FIG. 8 may be configured. In FIG. 9, each fixed-colored LED (L1A, L1B, L2, L3A, and L3B) has its own socket (e.g. socket 902) and lamp dome (e.g. lamp dome 904). Wire 702 has the L1A lamps coupled in series therealong, where each LIB lamp is coupled to a corresponding L1A lamp in parallel and in reverse orientation using extended wires 910, 912. Similarly, wire 706 has the L3A lamps coupled in series therealong, where each L3B lamp is coupled to a corresponding L3A lamp in parallel and in reverse orientation using the extended wires. FIG. 10 is different from that shown and described in relation to FIG. 9, in that each pair of fixed-colored LEDs (L1A and L1B pair; and L3A and L3B pair) shares the same socket (e.g. socket 1002). Wire 702 has the L1A lamps and L1B lamps coupled in series therealong, where each LIB lamp is coupled to a corresponding L1A lamp in parallel and in reverse orientation within the same socket 1002. Similarly, wire 706 has the L3A lamps and L3B lamps coupled in series therealong, where each L3B lamp is coupled to a corresponding L3A lamp in parallel and in reverse orientation within the same socket. Preferably, each fixed-colored LED has a flat or rectangular profile for better accommodation or fit within the same socket.

Figure 11:
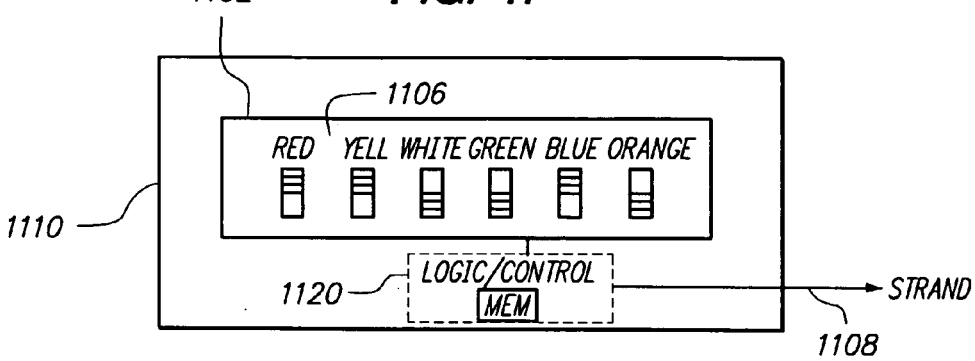
FIG. 11 is a dip switch which may be utilized as the decorating selector for selecting colors and color schemes in the lamps along the decorative light strand.

FIG. 11 is a different configuration for an alternative switch 1102 to be utilized as the decorating selector 104 of FIG. 1 for selecting colors in the lights. In this embodiment, switch 1102 is actually a dip switch which provides for the selection of specific colors to be turned on/off. A housing 1110 carries the dip switch, which is coupled to logic/control circuitry 1120. Logic/control circuitry 1120 includes memory and is carried within housing 1110. A light strand 1108 is coupled to logic/control circuitry 1120 and may be directly connected to housing 1106. An exposed switch portion 1106 on housing 1110 reveals settable color-control switches which include red, yellow, white, green, blue, and orange; however additional color switches associated with different colors may be provided. Color indicators are provided on a surface of housing 1110 as shown. In an alternative embodiment, switch 1102 is provided in a housing separate from housing 1110 but has a cable which is directly attached to it. The decorative lighting apparatus in this embodiment generally has a similar structure and functionality as that described in relation to FIGS. 1–10, where decorative outcomes similar to those described may be achieved utilizing a dip switch technique such that the end-user has complete control over each color where possible.

Specifically, the memory of logic/control circuitry 1120 of FIG. 11 includes color data corresponding to each color that is associated with a color-control switch. Alternatively, the memory includes color scheme data corresponding to each setting combination of color-control switches in switch 1102. Logic/control circuitry 1120 is operative as follows. If only a first switch associated with a first color (e.g. red) is set by the end user, then logic/control circuitry 1120 identifies color data corresponding to red and controls the lamps to be illuminated with the color red along strand 1108 (e.g. $L_1$=red, $L_2$=off, $L_3$=off, repeat). If subsequently a second switch associated with a second color (e.g. white) is set by the end user, then logic/control circuitry 1120 identifies color data corresponding to white and controls the lamps to be illuminated in repeated interleaved sequence of red and white along strand 1108 (e.g. $L_1$=red, $L_2$=white, $L_3$=off, repeat). If subsequently a third switch associated with a third color (e.g. blue) is set by the end user, then logic/control circuitry 1120 identifies color data corresponding to blue and controls the lamps to be illuminated in repeated interleaved sequence of red, white, and blue along strand 1108 (e.g. $L_1$=red, $L_2$=white, $L_3$=blue, repeat). Light colors may be removed by the end user by unsetting the corresponding switch. As apparent, for each one of many possible combinations of one or more user-selectable color-control switches which have been set, the control circuitry illuminates the lamps with a color scheme corresponding to the one or more user-selectable color-control switches.

Figure 12:
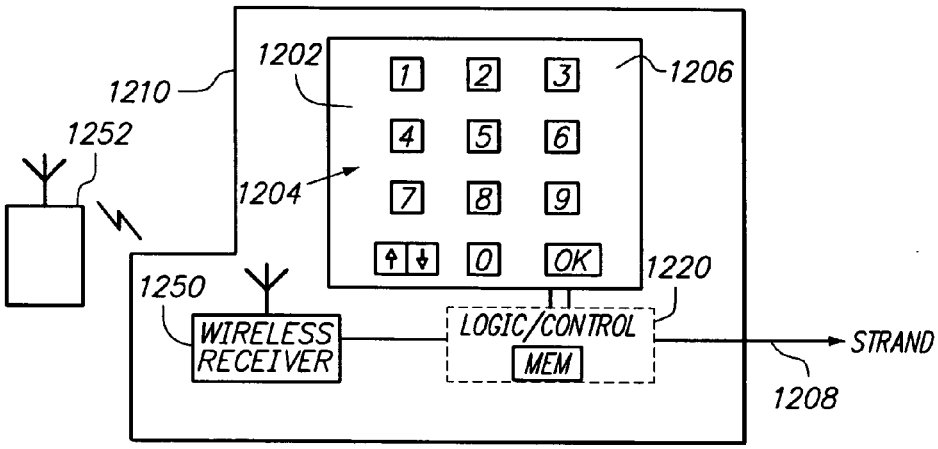
FIG. 12 is a keypad switch which may be utilized as the decorating selector for selecting color schemes in the lamps along the decorative light strand.

FIG. 12 is another alternative switch 1202 which may be alternatively utilized for the decorating selector 104 of FIG. 1. In this embodiment, switch 1202 is a keypad which provides for the selection of many preprogrammed holiday color schemes. A housing 1210 carries the keys of the keypad, which is coupled to logic/control circuitry 1220. Logic/control circuitry 1220 includes memory and is carried within housing 1210. A light strand 1208 is coupled to logic/control circuitry 1220 and may be directly connected to housing 1210. In an alternative embodiment, switch 1202 is provided in a housing separate from housing 1210 but has a cable which is directly attached to it. An exposed keypad portion 1206 on housing 1210 reveals user-settable switches which include one or more keys 1204 corresponding to 0 to 9, "OK", and scheme-select switches FORWARD and BACK.

If wireless remote switching is utilized, a wireless receiver 1250 is carried within housing 1210 and coupled to logic/control circuitry 1220 and the keypad is part of a wireless remote controller 1252 which is battery-operated. Provided as a separate unit, wireless remote controller 1252 with the keypad includes a wireless transmitter and a controller which is coupled to keypad inputs. The wireless technique may utilize well-known radio frequency (RF) or infrared communications, as examples. The wireless remote switching may be important to provide an end user with mobility and thus visibility uniquely suited for the very different color schemes which may be illuminated at an inconvenient location (e.g. outside of the end user's house or building). This wireless remote switching may be used in connection with decorating selectors/switches other than a keypad, for example, the wireless remote switching may be utilized with the decorating selectors/switches shown and described in relation to FIG. 1 or FIG. 11.

The decorative lighting apparatus using switch 1202 of FIG. 12 has a somewhat similar structure and functionality as that described in relation to FIGS. 1–10. The memory of logic/control circuitry 1220 includes a stored list of color scheme data. Each listing of color scheme data is associated with one of a plurality of user-selectable entries (e.g. numeric entries) from the keypad and includes color data. The color schemes may be alternatively controlled or set using the scheme-select FORWARD and BACK keys, which select forward or back from the current listing. Preferably, the user-selectable entries (e.g. the numeric entries) are printed in association with an indication or name of the associated color scheme, either on housing 1210 directly or on a separate instruction sheet. For example, the print may recite the following: 1=all white; 2=Valentines Day; 3=St. Patrick's (type 1); 4=St. Patrick's (type 2); 5=Independence Day; 6=Halloween; 7=Christmas; etc.

Preferably, the memory of the logic/control circuitry is configured to store data for all major U.S. holiday color schemes (such as those described herein) and at least a few more celebratory schemes. Even more preferably, the memory is configured to store preprogrammed data associated with at least ten (10) or at least twenty (20) different color schemes associated with various U.S. holidays, celebratory events, national flags, and sports teams, such as those described herein, with or without different effects such as flashing, fading, and/or movement.

The lamps may be additionally or alternatively controlled by means other than by direct user input with the decorating selector. For example, color schemes in the decorative lighting apparatus may "automatically" (i.e. without user intervention) changed based on the time of season. In this case, a running date/clock timer of the circuitry is synchronized with the current date/time, and a change in the color scheme is selected based on the current date/time corresponding to the season. In particular, the circuitry includes the running timer which produces a date/clock value, a plurality of date/time period ranges stored in memory, and a comparator which compares the date/clock value with date/time period ranges stored in the memory. Each date/time period range is associated with a different color scheme (e.g. holiday color scheme) in the memory. The controller is further adapted to control its outputs to provide a different color scheme in the lamps based on each date/time period range within which the timer value falls. The running timer may be implemented within the controller, or as a timer circuit which is separate from the controller and having one or more outputs fed into the controller. Although preferred for the specific circuit arrangement of the present application, this specific circuitry and functionality may be provided in any suitable year-round holiday lighting apparatus without regard to the specific circuit implementation described herein.

Figure 13:
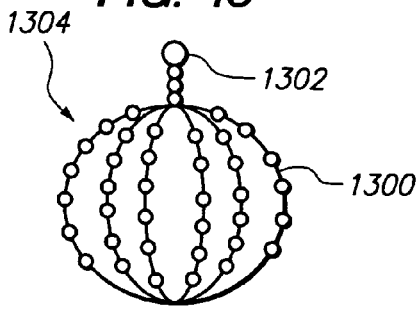
FIG. 13 is one example of an alternative decorative apparatus as a 3-dimensional structure (e.g. a decorative holiday ball).

FIG. 13 is an alternate embodiment of a decorative lighting apparatus. More particularly, FIG. 13 shows a decorative holiday ball 1300 which may be hung from a ceiling by an attachment 1302 (e.g. a chain or rope). In this embodiment, the decorative holiday ball 1300 is made from a skeletal structure of light-weight metal or plastic which is formed into a sphere. This sphere is decorated with the lamps which are positioned along the strand/wires, which are fixed along the structure. The sphere could also be decorated with other decorative materials such as decorative paper, streamers, etc. Ball 1300 is configured to function in the same manner as that described in relation to FIGS. 1–12, and is selectively illuminated with a different color scheme based on the user-selectable setting. Note that the sphere is just one example of a 3-dimensional structure which may be constructed; other structures such as a block or a star may be made, for example. Also alternatively, the structure may be a 2-dimensional structure which is formed into a rectangle or circle, for example.

Final Comments. As described herein, a decorative lighting apparatus provides user-selectable color schemes corresponding to several holidays, and other occasions and themes, for year-round use. In one illustrative example, a decorative lighting apparatus includes a decorative light strand having a first wire with a first plurality of lamps coupled in series therealong, a second wire with a second plurality of lamps coupled in series therealong, a third wire with a third plurality of lamps coupled in series therealong, and a return wire coupled to ends of the first, the second, and the third wires. Each lamp of the first plurality has a first light-emitting diode (LED) device (e.g. red) which is coupled in parallel and in reverse orientation with a second LED device (e.g. orange/yellow), each lamp of the second plurality has a third LED device (e.g. blue) which is coupled in parallel and in reverse orientation with a fourth LED device (e.g. green), and each lamp of the third plurality has at least a fifth light-emitting diode (LED) device (e.g. white). Preferably, each lamp of the first and the second pluralities is a two-leaded bipolar, bicolor LED. The first, the second, and the third wires are positioned together such that each lamp of the first, the second, and the third pluralities are positioned adjacent to each other but sufficiently separated such that little or no color mixing occurs between the lamps. A controller includes a first output for controlling an illumination of a color in the first plurality of lamps along the first wire, a second output for controlling an illumination of a color in the second plurality of lamps along the second wire, and a third output for controlling an illumination of a color in the third plurality of lamps along the third wire. The decorative light strand also includes a decorating selector which provides for a plurality of user-selectable switch settings. The controller is adapted to control the first, the second, and the third outputs to provide a different color scheme in the first, the second, and the third pluralities of lamps for each user-selectable switch setting of the decorating selector. Some of the different color schemes consist of two colors which are simultaneously illuminated along the decorative light strand, and other color schemes consist of three colors which are simultaneously illuminated along the decorative light strand.

Advantageously, the decorative light strand may be hung permanently and utilized year-round for major holidays as well as for other suitable themes and occasions. In a color-scheme-controllable light strand, the use of such LEDs as described provides for flexibility in the choice of colors through use of color setting techniques, reduces the number of (or eliminates) non-lit lamps for many color schemes, provides the light strand with a long-life which is especially desirable in a year-round application, and reduces the number of wired lines to the lamps.

It is to be understood that the above is merely a description of preferred embodiments of the invention and that various changes, alterations, and variations may be made without departing from the true spirit and scope of the invention as set for in the appended claims. The several embodiments and variations described above can be combined with each other where suitable. The particular color schemes for the holidays described herein are merely examples and may vary. It is not necessary that the plurality of wires along the decorative light strand be intertwined or bound; they could be provided in a 2-dimensional matrix or 3-dimensional structure. Also, the lights in each set need not be interleaved with lights of another set or sets. Few if any of the terms or phrases in the specification and claims has been given any special particular meaning different from the plain language meaning, and therefore the specification is not to be used to define terms in an unduly narrow sense.

What is claimed is:

1. A decorative lighting apparatus, comprising:

a first wire having a first plurality of lamps coupled in series therealong;

a second wire having a second plurality of lamps coupled in series therealong;

a return wire coupled to ends of the first and the second wires;

each lamp of the first plurality comprising a first light-emitting diode (LED) device which is coupled in parallel and in reverse orientation with a second LED device;

each lamp of the second plurality comprising a third LED device which is coupled in parallel and in reverse orientation with a fourth LED device;

the first and the second wires being positioned together such that each lamp of the first and the second pluralities are positioned adjacent to each other but sufficiently separated such that little or no color mixing occurs between lamps;

a controller;

a first output from the controller for controlling an illumination of a color in the first plurality of lamps along the first wire;

a second output from the controller for controlling an illumination of a color in the second plurality of lamps along the second wire;

a decorating selector which provides a plurality of user-selectable switch settings;

the controller being adapted to control the first and the second outputs to provide a different color scheme in the first and the second pluralities of lamps for each user-selectable switch setting; and at least some of the different color schemes comprising at least two different colors simultaneously illuminated in the first and the second pluralities of lamps.

2. The decorative lighting apparatus of claim 1, wherein each lamp of the first plurality comprises a bipolar, bicolor LED.

3. The decorative lighting apparatus of claim 1, wherein each lamp of the first plurality comprises a first two-leaded, bipolar, bicolor LED having a first lamp dome and each lamp of the second plurality comprises a second two-leaded, bipolar, bicolor LED having a second lamp dome.

4. The decorative lighting apparatus of claim 1, wherein each lamp of the first plurality at least provides for the colors red and yellow/orange and each lamp of the second plurality at least provides for the colors blue and green.

5. The decorative lighting apparatus of claim 1, wherein each lamp of the first plurality comprises a first bipolar, bicolor LED which includes the first and the second LED devices, the first LED device having a first wavelength within a range of between 610–680 nanometers (nm) and the second LED device having a second wavelength different from the first wavelength within a range of between 570–640 nm, and wherein each lamp of the second plurality comprises a second bipolar, bicolor LED which includes the third and the fourth LED devices, the third LED device having a third wavelength within a range of between 420–480 nm and the fourth LED device having a fourth wavelength different from the third wavelength within a range of between 505–560 nm.

6. The decorative lighting apparatus of claim 1, wherein each different color scheme comprises at least four different U.S. holiday color schemes.

7. The decorative lighting apparatus of claim 1, further comprising:

a timer which produces a date/time value;

a plurality of date/time period ranges stored in memory, each date/time period range being associated with a different color scheme;

a comparator which compares the date/timer value with date/time period ranges stored in the memory; and the controller being adapted to control the first and the second outputs to provide a different color scheme in the first and the second pluralities of lamps based on each date/time period range within which the timer value falls.

8. The decorative lighting apparatus of claim 1, wherein the first, the second, and the third wires are positioned together such that the lamps of the first, the second, and the third pluralities are positioned adjacent to each other so as to provide the different color schemes as repeated color sequences.

9. The decorative lighting apparatus of claim 1, further comprising:

an AC power source;

a first AC line switch having an input coupled to the first output from the controller and an output coupled to the first wire; and a second AC line switch having an input coupled to the second output from the controller and an output coupled to the second wire.

10. The decorative lighting apparatus of claim 1, further comprising:

a third wire of the decorative light strand having a third plurality of lamps coupled in series along the third wire;

the return wire being further coupled to an end of the third wire;

each lamp of the third plurality comprising at least a fifth light-emitting diode (LED) device;

a third output from the controller for controlling an illumination of a color in the third plurality of lamps along the third wire;

the first, the second, and the third wires being positioned together such that each lamp of the first, the second, and the third pluralities are positioned adjacent to each other but sufficiently separated such that little or no color mixing occurs between the lamps;

the controller being adapted to control the first, the second, and the third outputs to provide the different color scheme in the first, the second, and the third pluralities of lamps for each user-selectable switch setting; and at least some of the different color schemes comprising at least three colors which are simultaneously illuminated in the first, the second, and the third pluralities of lamps.

11. The decorative lighting apparatus of claim 10, wherein each different color scheme comprises a plurality of different state/national flag color schemes.

12. A decorative lighting apparatus, comprising:

a first wire having a first plurality of lamps coupled in series therealong;

a second wire having a second plurality of lamps coupled in series therealong;

a third wire having a third plurality of lamps coupled in series therealong;

a return wire coupled to ends of the first, the second, and the third wires;

each lamp of the first plurality comprising a first light-emitting diode (LED) device which is coupled in parallel and in reverse orientation with a second LED device;

each lamp of the second plurality comprising a third LED device which is coupled in parallel and in reverse orientation with a fourth LED device;

each lamp of the third plurality comprising at least a fifth light-emitting diode (LED) device;

a controller;

a first output from the controller for controlling an illumination of a color in the first plurality of lamps along the first wire;

a second output from the controller for controlling an illumination of a color in the second plurality of lamps along the second wire;

a third output from the controller for controlling an illumination of a color in the third plurality of lamps along the third wire;

each lamp of the first, the second, and the third pluralities being sufficiently separated such that little or no color mixing occurs between lamps;

a decorating selector which provides a plurality of user-selectable switch settings;

a controller which is adapted to control the first, the second, and the third outputs to provide a different color scheme in the first, the second, and the third pluralities of lamps for each user-selectable switch setting;

at least some of the different color schemes consisting of two colors which are simultaneously illuminated in the lamps; and at least some of the different color schemes consisting of three colors which are simultaneously illuminated in the lamps.

13. The decorative lighting apparatus of claim 12, further comprising:

wherein the first, the second, and the third wires are positioned together so that the lamps of the first, the second, and the third pluralities are positioned adjacent to each other to provide the different color schemes as repeated color sequences.

14. The decorative lighting apparatus of claim 12, wherein each lamp of the first plurality comprises a first bipolar, bicolor LED having a first lamp dome and each lamp of the second plurality comprises a second bipolar, bicolor LED having a second lamp dome.

15. The decorative lighting apparatus of claim 12, wherein each lamp of the first plurality provides for the colors red and yellow/orange, and each lamp of the second plurality provides for the colors blue and green.

16. The decorative lighting apparatus of claim 12, wherein the different color schemes include:

a first color scheme consisting of the color white;

a second color scheme which includes the colors red and green which are simultaneously illuminated along the decorative light strand; and a third color scheme which consists of the colors red, white, and blue which are simultaneously illuminated along the decorative light strand.

17. The decorative lighting apparatus of claim 12, wherein each different color scheme comprises a plurality of different U.S. holiday color schemes.

18. The decorative lighting apparatus of claim 12, wherein each different color scheme comprises a plurality of different state/national flag color schemes.

19. The decorative lighting apparatus of claim 12, wherein an AC power source is coupled to the return line and the apparatus further comprises:

at least portions of positive half-cycles of an AC waveform driving the first LED devices and the third LED devices; and at least portions of negative half-cycles of the AC waveform driving the second LED devices and the third LED devices.

20. A decorative lighting apparatus, comprising:

a first wire having a first plurality of lamps coupled in series therealong;

a second wire having a second plurality of lamps coupled in series therealong;

a return wire coupled to ends of the first and the second wires;

each lamp of the first plurality comprising a first light-emitting diode (LED) device which is coupled in parallel and in reverse orientation with a second LED device;

each lamp of the second plurality comprising a third LED device which is coupled in parallel and in reverse orientation with a fourth LED device;

the first and the second wires being positioned together such that each lamp of the first and the second pluralities are positioned adjacent to each other but sufficiently separated such that little or no color mixing occurs between lamps;

a decorating selector which provides a plurality of user-selectable switch settings;

a controller;

a first output from the controller for controlling an illumination of a color in the first plurality of lamps along the first wire;

a second output from the controller for controlling illumination of a color in the second plurality of lamps along the second wire;

the controller being adapted to control the first and the second outputs to provide a different color scheme in the first and the second pluralities of lamps for each user-selectable switch setting;

the different color schemes including:

a first color scheme which consists of the color white;

a second color scheme which includes the colors red and green which are simultaneously illuminated along the decorative light strand;

a third color scheme which includes the colors red and white which are simultaneously illuminated along the decorative light strand;

a fourth color scheme which includes the color green and white which are simultaneously illuminated along the decorative light strand; and a fifth color scheme which includes the color blue.

21. A decorative lighting apparatus, comprising:

a first plurality of two-leaded, fixed-color light-emitting diodes (LEDs) coupled in series along a first wire of the decorative light strand;

a second plurality of two-leaded, fixed-color LEDs, each of which is coupled in parallel and in reverse orientation with a corresponding LED of the first plurality;

a third plurality of two-leaded, fixed-color LEDs coupled in series along a second wire of the decorative light strand;

a fourth plurality of two-leaded, fixed-color LEDs, each of which is coupled in parallel and in reverse orientation with a corresponding LED of the third plurality;

the first and the second wires being positioned together such that each lamp of the first and the second pluralities are positioned adjacent to each other but sufficiently separated such that little or no color mixing occurs between lamps;

a decorating selector which provides a plurality of user-selectable switch settings;

a controller;

a first output from the controller for controlling an illumination of the first and the second pluralities of LEDs along the first wire;

a second output from the controller for controlling an illumination of the third and the fourth pluralities of LEDs along the second wire;

the controller being adapted to control the first and the second outputs to provide a different color scheme in the first, the second, the third, and the fourth pluralities of LEDs for each user-selectable switch setting; and at least some of the different color schemes comprising at least two colors which are simultaneously illuminated along the decorative light strand.

* * * * *